US005356207A

United States Patent [19]

Röck et al.

[11] Patent Number: 5,356,207

[45] Date of Patent: Oct. 18, 1994

[54] BRAKING DEVICE FOR DRAWERS

[75] Inventors: Erich Röck, Höchst, Austria; Fredi Dubach, Adetswil, Switzerland

[73] Assignee: Julius Blum Gesellschaft m.b.H., Höchst, Austria

[21] Appl. No.: 962,191

[22] PCT Filed: Apr. 29, 1992

[86] PCT No.: PCT/AT92/00063

§ 371 Date: Dec. 21, 1992

§ 102(e) Date: Dec. 21, 1992

[87] PCT Pub. No.: WO92/19131

PCT Pub. Date: Nov. 12, 1992

[30] Foreign Application Priority Data

May 2, 1991 [AT] Austria ..... A 913/91

[51] Int. Cl.[5] ..... A47B 88/00

[52] U.S. Cl. ..... 312/334.46; 312/334.42; 312/333

[58] Field of Search ..... 312/333, 330.1, 332, 312/334.22, 334.27, 334.32, 334.44, 334.46; 70/85, 95; 16/82; 384/21

[56] References Cited

U.S. PATENT DOCUMENTS

| | | | |
|---|---|---|---|
| 4,610,487 | 9/1986 | Delmege et al. | 384/18 |
| 4,765,699 | 8/1988 | Bessinger | 312/334.46 |
| 5,033,805 | 7/1991 | Hobbs | 312/334.46 X |

FOREIGN PATENT DOCUMENTS

| | | |
|---|---|---|
| 366901 | 5/1982 | Austria . |
| 2421657 | 11/1975 | Fed. Rep. of Germany . |
| 3716923 | 12/1988 | Fed. Rep. of Germany . |
| 8908642 | 1/1990 | Fed. Rep. of Germany . |
| 4028878 | 3/1991 | Fed. Rep. of Germany . |

*Primary Examiner*—Peter R. Brown
*Assistant Examiner*—N. Mulcare
*Attorney, Agent, or Firm*—Wenderoth, Lind & Ponack

[57] ABSTRACT

A device for braking a drawer slidable within a body by a pull-out rail on the drawer, a support rail on the body and rollers running therebetween. The device includes a brake rail is secured to one of the body or the drawer. Two brake shoes are mounted to be movable along the brake rail in the direction of movement of the drawer. The shoes are activated by a stop on other of the drawer or the body. The shoes are connected to the brake rail by a spring. The stop moves the brake shoes against the action of the spring.

47 Claims, 19 Drawing Sheets

BRAKING DEVICE FOR DRAWERS

BACKGROUND OF THE INVENTION

The invention relates to a braking device for braking movement of a drawer. The braking device is effective only in one predetermined position of the drawer, preferably a completely pushed in position thereof. Each side of the drawer is guided for sliding movement by a guide fitting including a drawer side pull-out rail, a body side support rail, and rollers or the like rolling between such rails. The braking device includes one or more brake shoes to engage with a part that is moved relative to the brake shoes when the drawer is pushed into the body.

A braking device of this type is disclosed in DE-A1-37 16 923. Its task is to prevent the drawer from being pushed too strongly into a furniture body when the action drawer movement is very easy, and in particular to prevent a drawer pushed into the furniture body from rolling out of the furniture body owing to the excess energy.

SUMMARY OF THE INVENTION

Accordingly, the object of the invention is to provide an improved braking device of the type described above.

This object is achieved according to the invention in an advantageous manner by providing that the brake shoe(s), which engage(s) with at least one well-known rail brake attached to the furniture body or to the drawer, can be moved in the sliding direction of the drawer both relative to the drawer and also relative to the furniture body and is (are) connected directly or indirectly to the rail brake by way of a spring. A stop or roller at the drawer or at the furniture body moves the brake shoes counter to the force of the spring. An advantageous arrangement provides that two brake shoes are mounted on a U-shaped support to envelop a single brake rail flange or can be spread apart between two brake rail flanges. An especially good braking action is obtained by connecting the brake shoes by means of a toggle joint, where a spring-loaded ram which is braced against the U-shaped support is hinged to the toggle joint and where the stop strikes the ram.

BRIEF DESCRIPTION OF THE DRAWINGS

Other objects, features and advantages of the present invention will be apparent from the following detailed description of preferred embodiments of the present invention, with reference to the accompanying drawings, wherein.

DETAILED DESCRIPTION OF THE INVENTION

Figure 1:
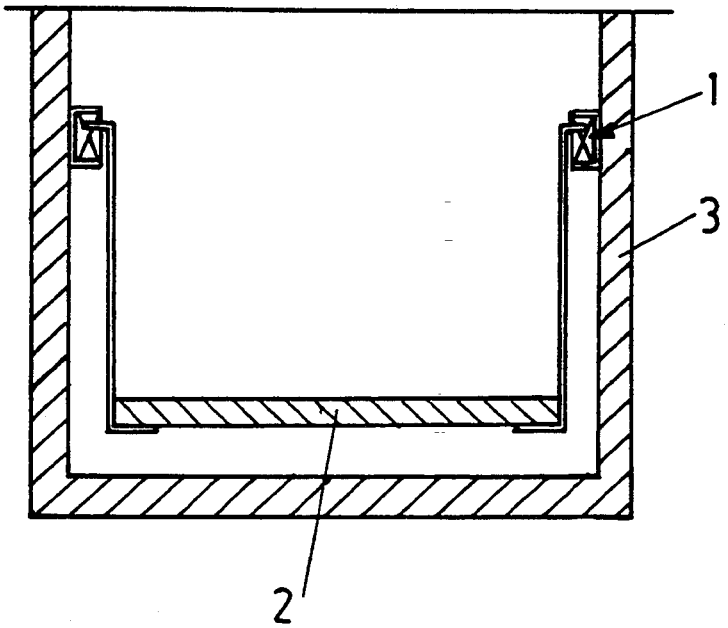
FIG. 1 is a transverse cross section through a furniture body and drawer schematically illustrating braking devices in accordance with the invention assembled on each of opposite sides of the drawer.
Figure 2:
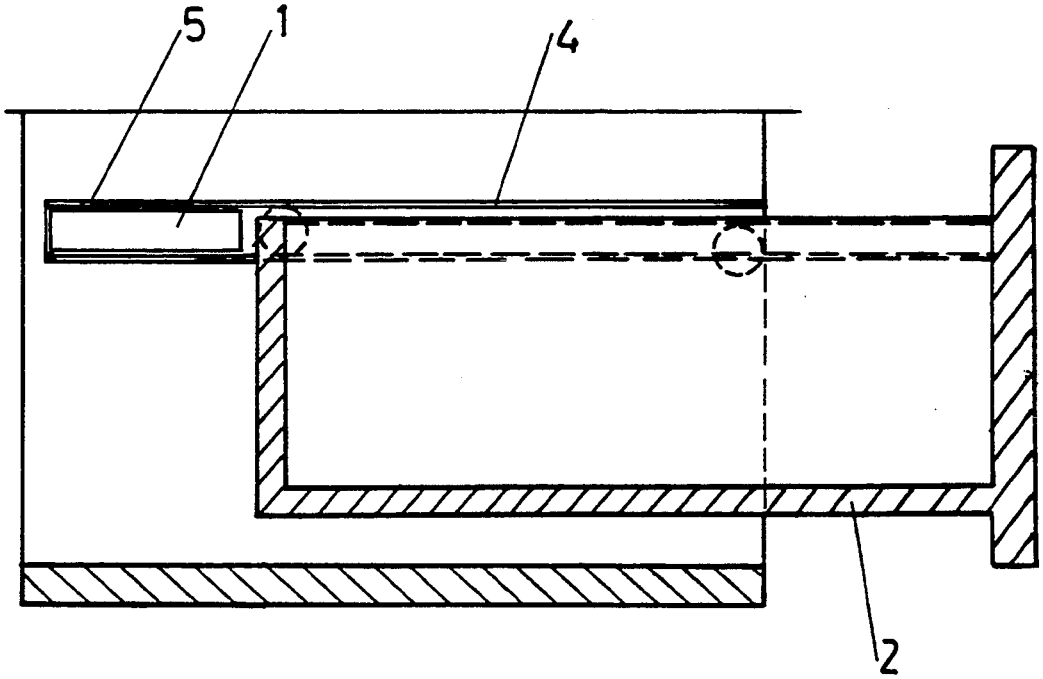
FIG. 2 is a schematic longitudinal cross section of the assembly of FIG. 1.
Figure 3:
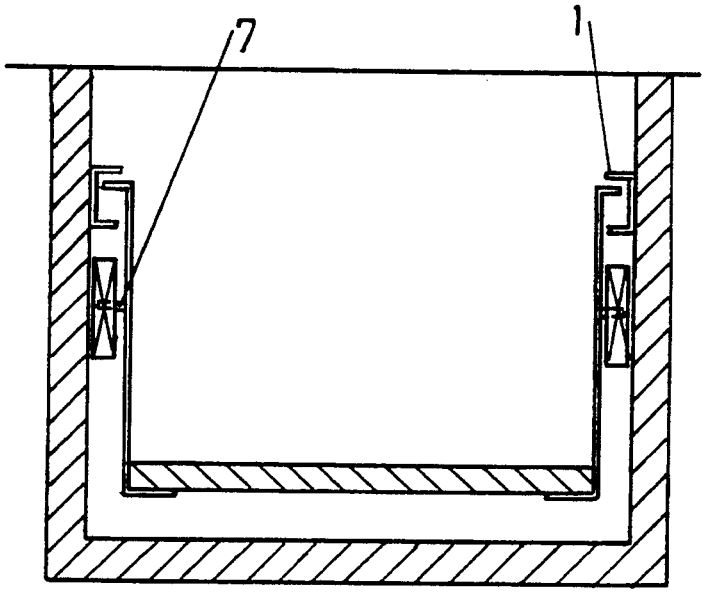
FIGS. 3 and 4 are views similar to FIGS. 1 and 2, respectively, but schematically illustrating a different placement of braking devices.
Figure 4:
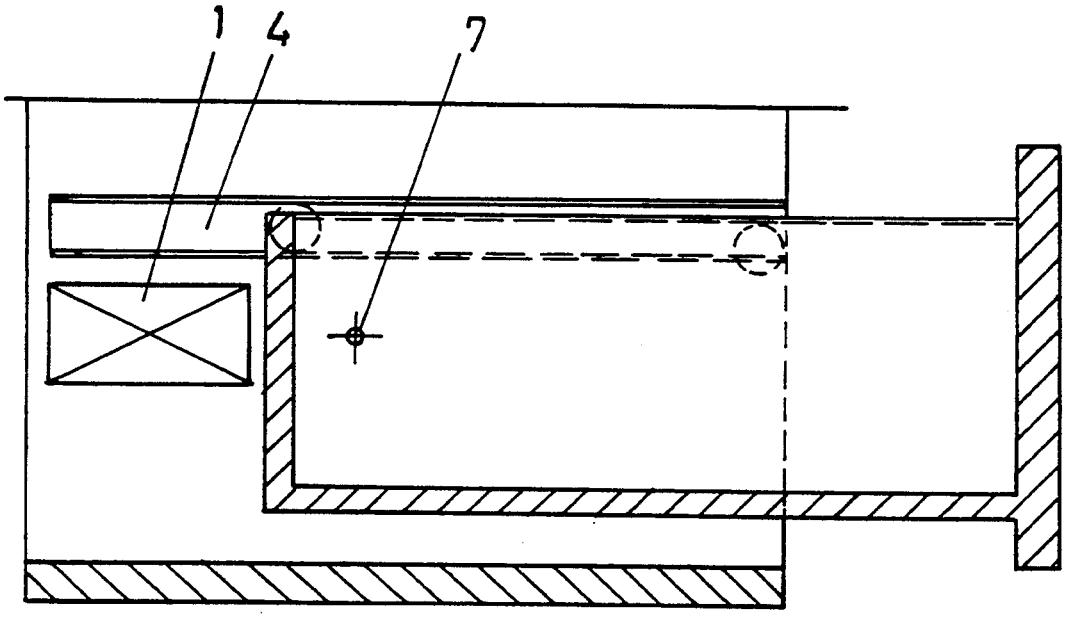
Figure 5:
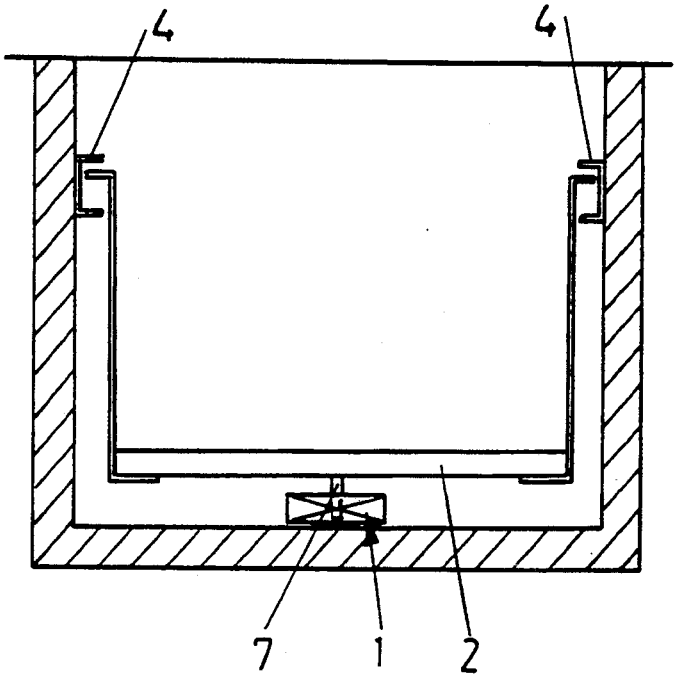
FIGS. 5 and 6 are views similar to FIGS. 1 and 2, respectively, but schematically showing a braking device located beneath a bottom of a drawer.
Figure 6:
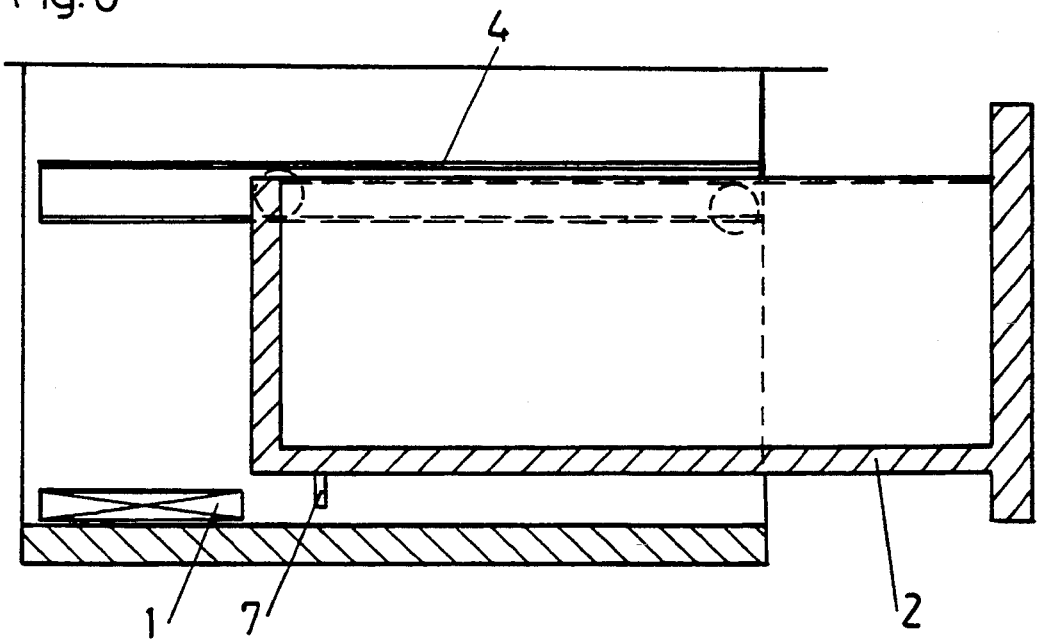

As will be apparent from FIGS. 1 to 6, the braking device 1 according to the invention can be mounted both below a drawer bottom 2 (FIGS. 5 and 6) and on a body side wall 3. If the braking device 1 is situated on the body side wall 3, it can be attached either below (FIGS. 3 and 4) or above a body side support rail 4 connected directly to the body side wall 3, or it can also be integrated with the support rail 4, as is apparent in the embodiment of FIGS. 1 and 2, the rear end of the support rail 4 forming a rail 5 of the braking device.

In the illustrated embodiments, the essential functional parts of the braking device, i.e. a brake rail 5 and brake shoes 6, are mounted on the side of the body, whereas an element such as a stop or projection 7 is attached to the drawer. However, a reverse mounting is possible.

Figure 7A:
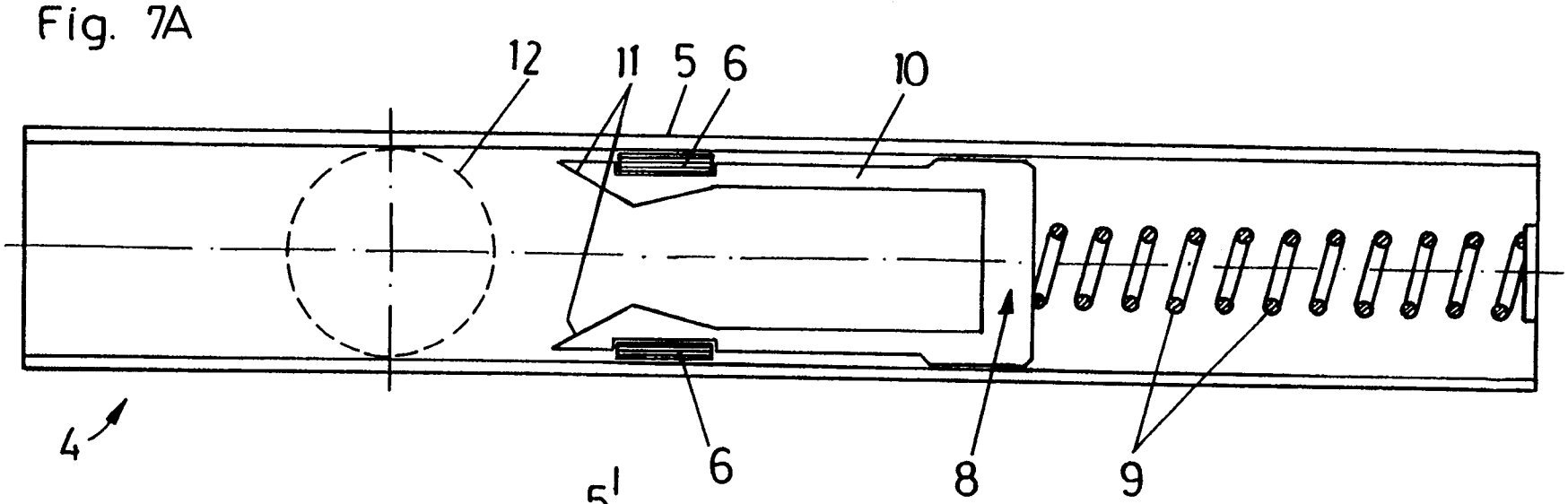
FIG. 7A is a side view of a braking device in accordance with one preferred embodiment of the invention.
Figure 7B:
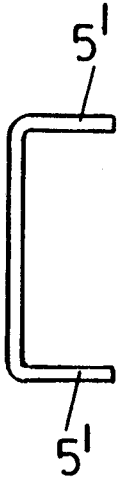
FIG. 7B is an end view of a rail of the braking device of FIG. 7A.
Figure 8:
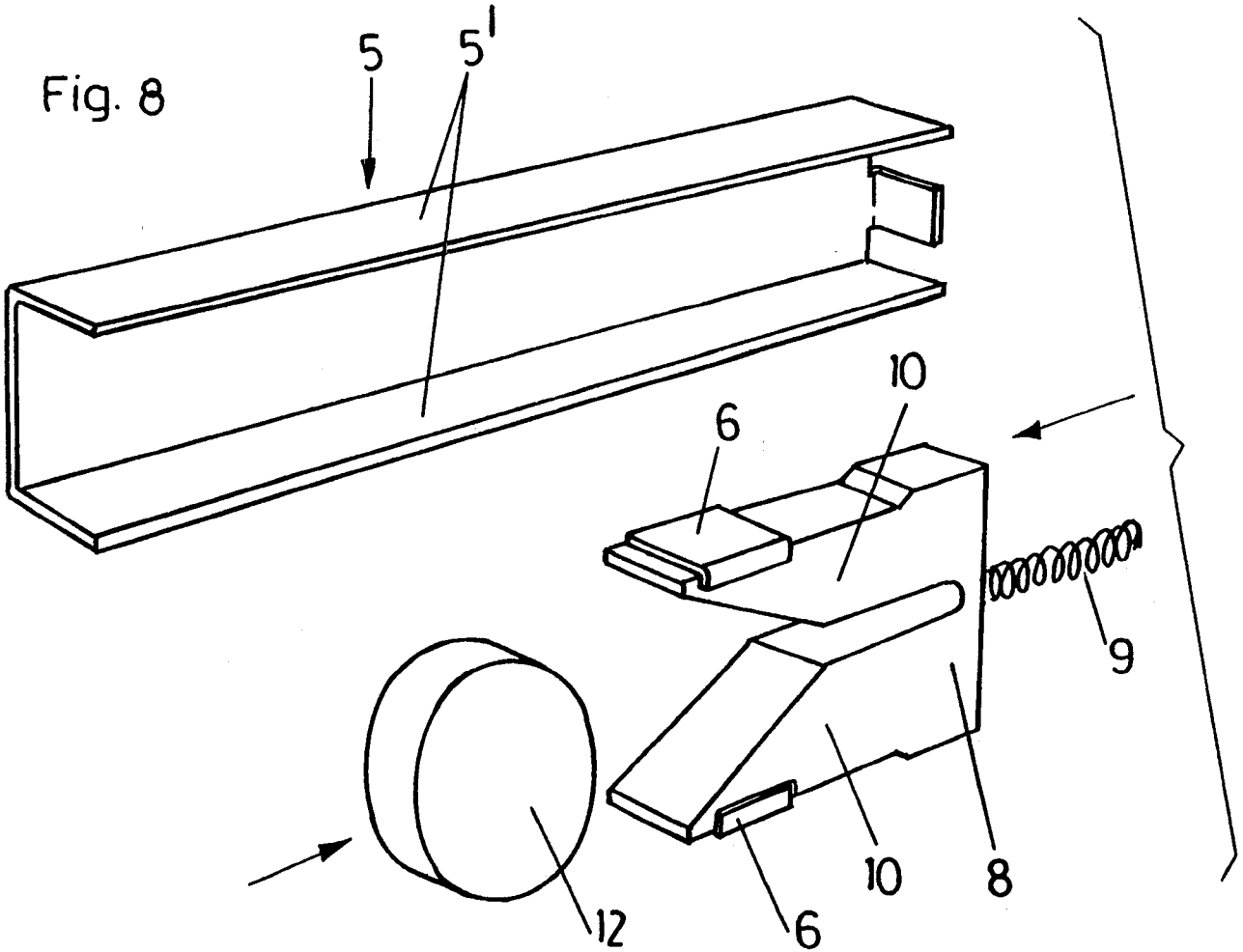
FIG. 8 is an exploded perspective view of the braking device of FIGS. 7A–7B.

In the embodiment according to FIGS. 7A–8, a rear part of the support rail 4 forms the rail 5 of the braking device. A brake member is in the form of a U-shaped support 8, which supports the brake shoes 6, is movable longitudinally within the rail 5. The U-shaped support 8 is urged by a pressure spring 9 that pushes the U-shaped support 8 in a direction counter to the slide-in direction of the drawer. Free ends of arms 10 of the U-shaped support 8 that bear the brake shoes 6 have internally inclined surfaces 11, that converge in the direction of the interior of the U-shaped support 8. If the drawer is slid into the furniture body, a rear roller 12 of the drawer forming the stop or projection strikes the inclined surfaces 11 of the U-shaped support 8. The U-shaped support 8 thereby is moved to the rear against the pressure of the spring 9 and the arms 10 are simultaneously spread apart. Thus, the brake shoes 6 come to rest against inner surfaces of flanges 5' of the rail 5 and movement of the drawer thereby is braked.

Figure 9A:
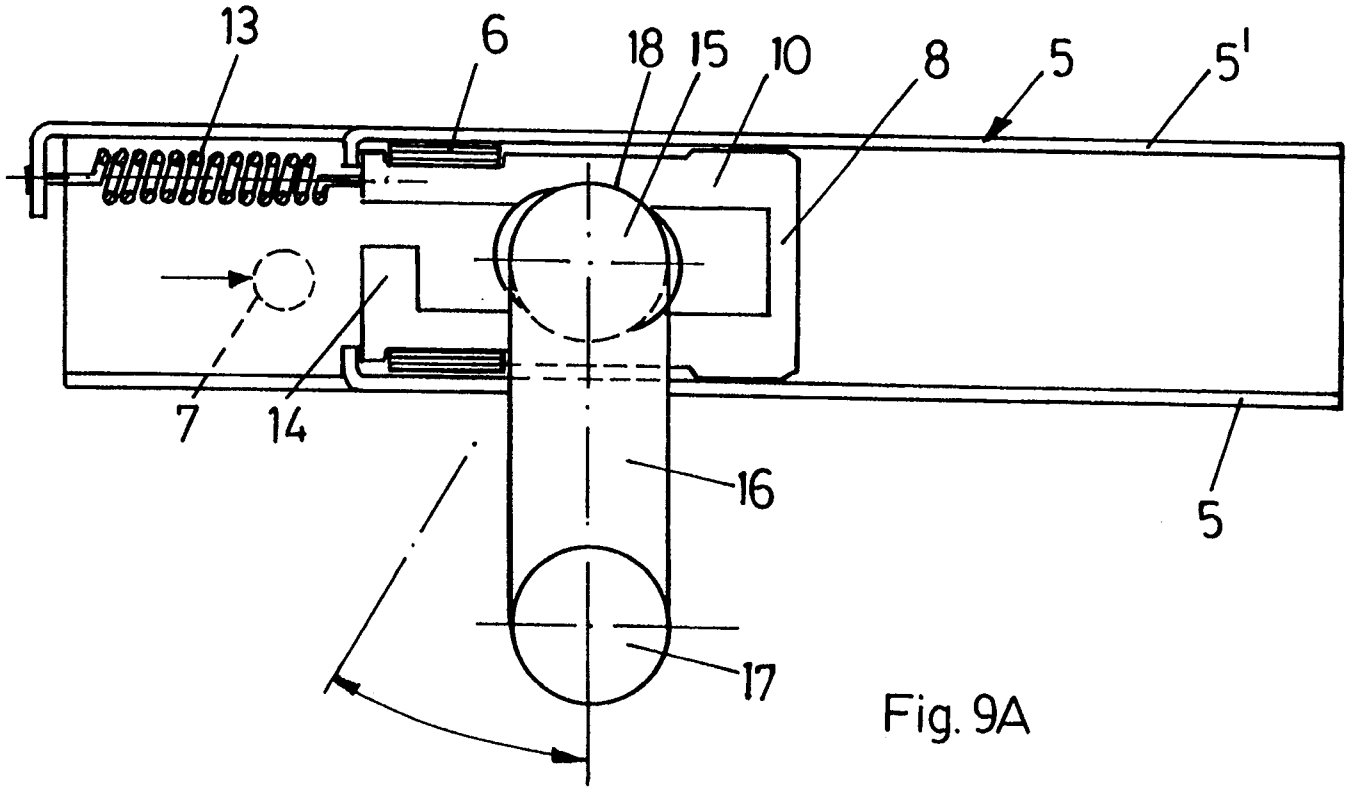
FIGS. 9A–10 are views similar to FIGS. 7A–8, respectively, but illustrating another embodiment of the present invention.
Figure 9B:
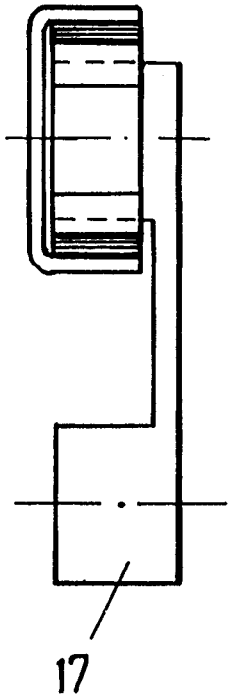
Figure 10:
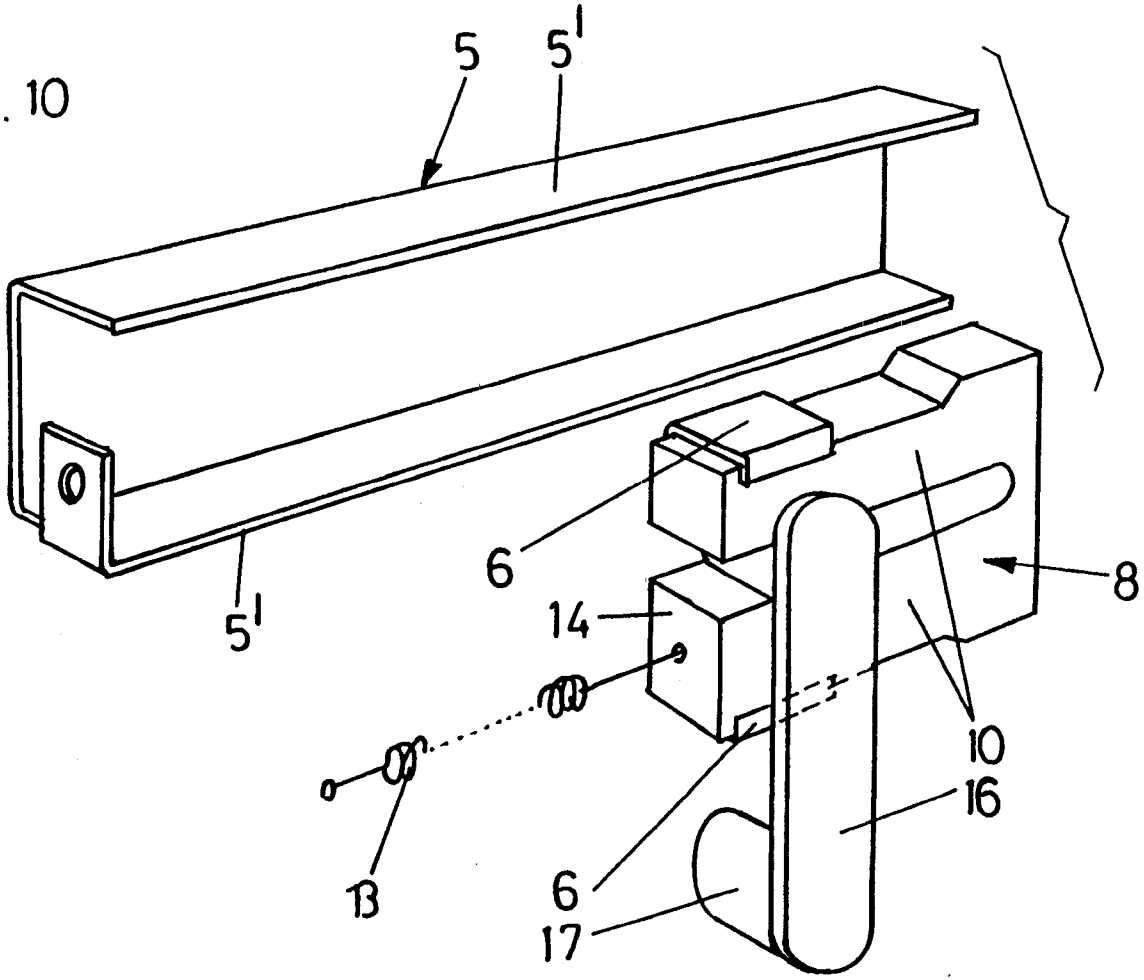

The braking device 1 according to the embodiment of FIGS. 9A–10 is mounted advantageously on the body side wall 3 adjacent the support rail 4. The device again includes a U-shaped support 8 that is guided for longitudinal movement in a rail 5 having a U-shaped cross section. The U-shaped support 8 bears brake shoes 6 is connected to the rail 5 by means of a tension spring 13. Facing the drawer, one arm 10 of the U-shaped support includes a stop bracket 14 against which the stop 7 of the drawer strikes. A brake cam 15 is disposed between the two arms 10. A pendulous arm 16 with a swinging member or weight 17 is integral with the brake cam 15. The cam 15 is positioned between circular recesses 18 formed in the arms 10. If the stop 7 strikes the stop bracket 14, the U-shaped support 8 is tilted suddenly towards the bottom against the action of the spring 13. Thus, the pendulous arm 16 swings in the direction of the arrow in FIG. 9A. Due to the swivelling motion of the lever 16, the cam 15 is rotated and the arms 10 are spread apart, with the result that the brake shoes 6 are pressed against the flanges 5' of the rail 5. Braking of the drawer thus commences.

Figures 11A, 11B, 11C:
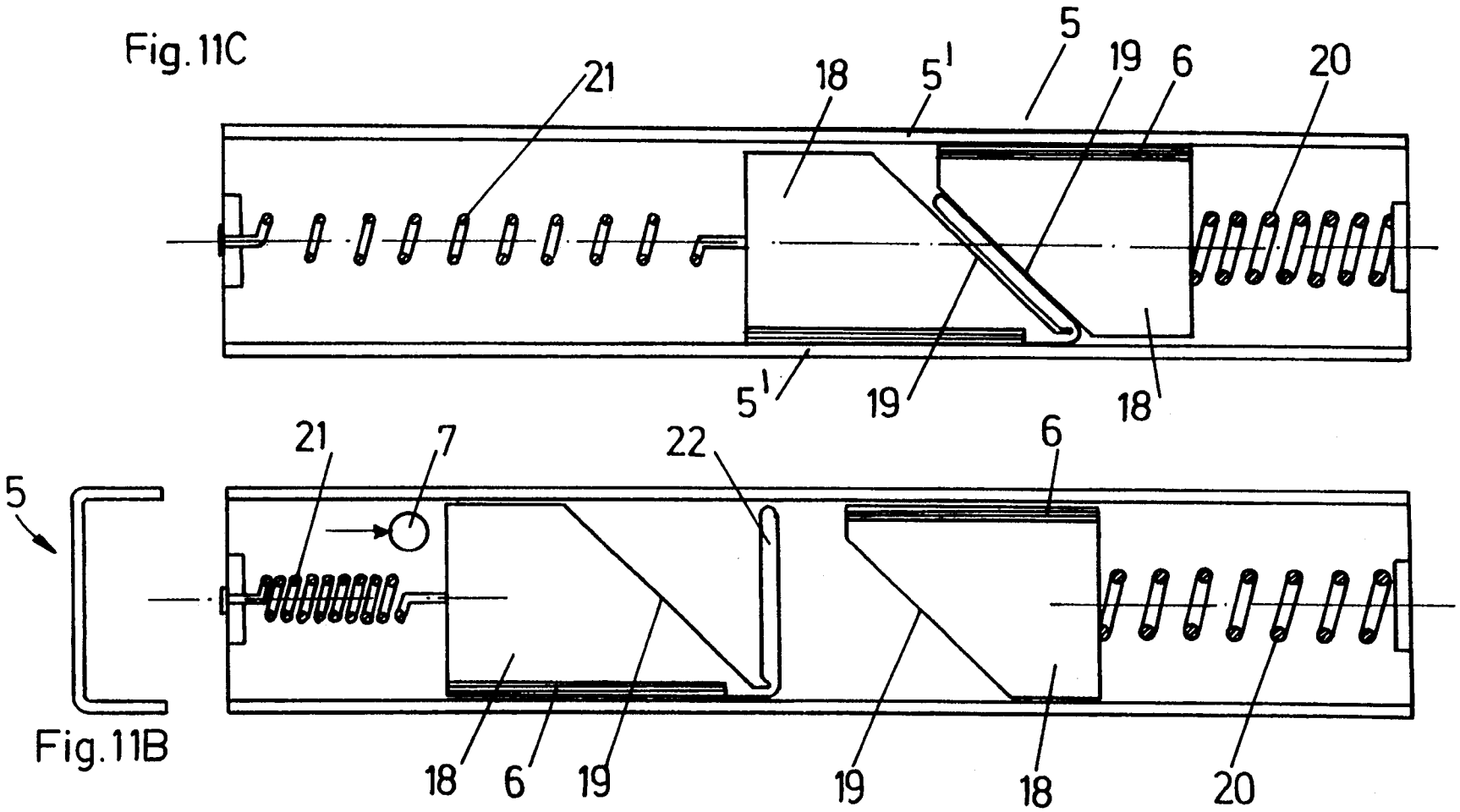
FIGS. 11A, 11B and 12 are views similar to FIGS. 7A–8, respectively, but showing a yet further embodiment of the present invention.
FIG. 11C is a further side view similar to FIG. 11A but illustrating a clamped braking condition of the device thereof.
Figure 12:
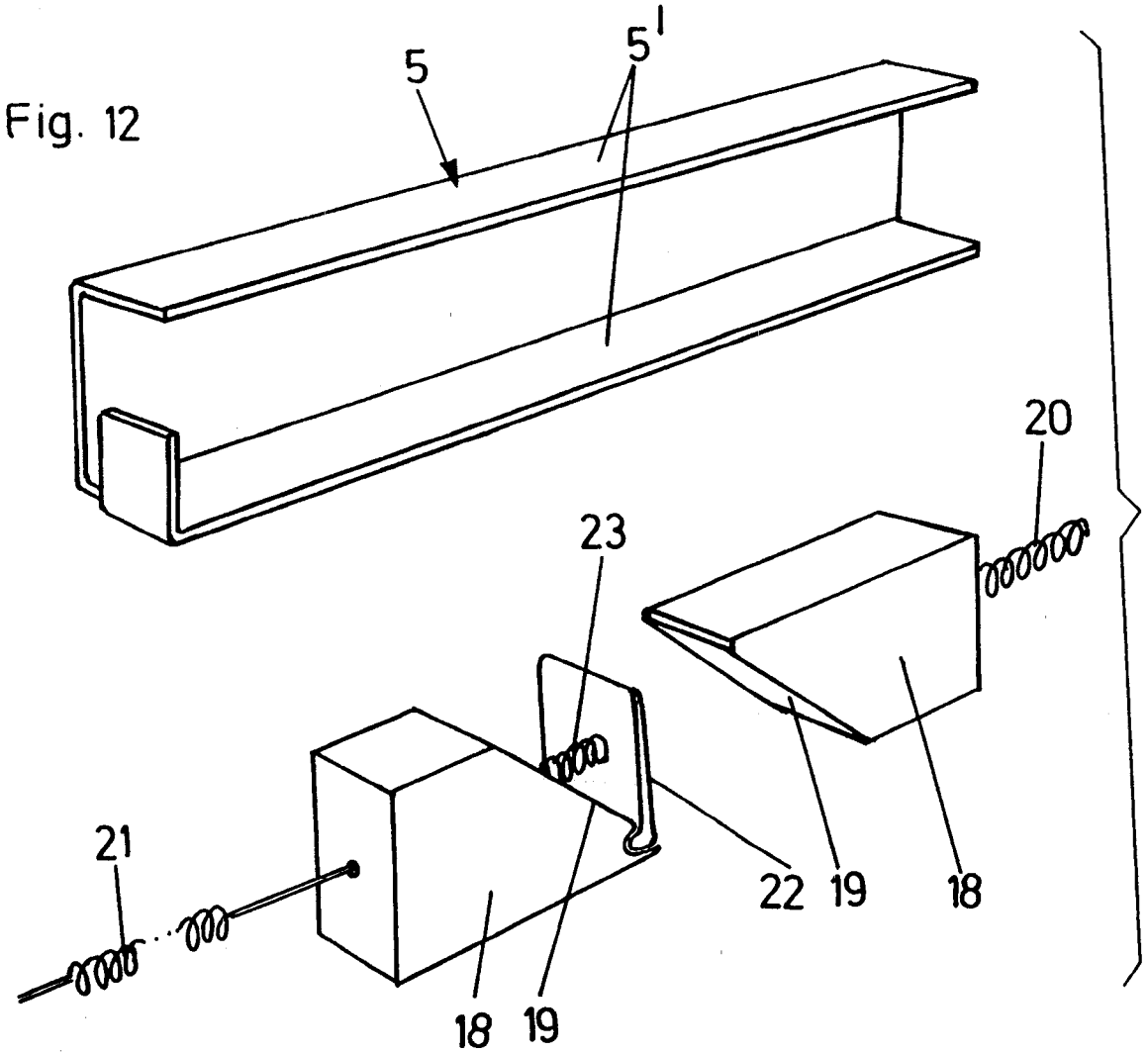

In the embodiment according to FIGS. 11A–12, a brake member is in the form of two wedge-shaped members 18 disposed for longitudinal movement in the rail 5. Members 18 support respective brake shoes 6. Members 18 have respective inclined wedge surfaces 19 that are aligned parallelly. The rear member 18 is stresses by a compression spring 20 that urges rear member 18 in a direction counter to the slide-in direction of the drawer. The front member 18 is suspended from rail 5 by a tension spring 21. The front member 18 is provided with an integral elastic tongue or projection 22 operable to put pressure on the wedge surface 19 of the other or rear member 18 during braking to increase a relative spreading action between the members. This spreading action can be increased further by arranging another compression spring 23 between the elastic tongue 22 and the front member 18, to which it can be molded. When the stop 7 of the drawer strikes the front member 18 during slide-in movement of the drawer, front member 18 moves to the rear until it strikes the rear member 18. This movement of the front member 18 is retarded by the spring 21. When the two members 18 strike, their wedge surfaces 19 are displaced alone each other, since the spring 20 lessens or decreases further rearward movement of the members 18. Due to the relative sliding apart of members 18 along the wedge surfaces 19, the brake linings 6 are forced against the rail flanges 5'. Thereby, braking starts.

Figure 13A:
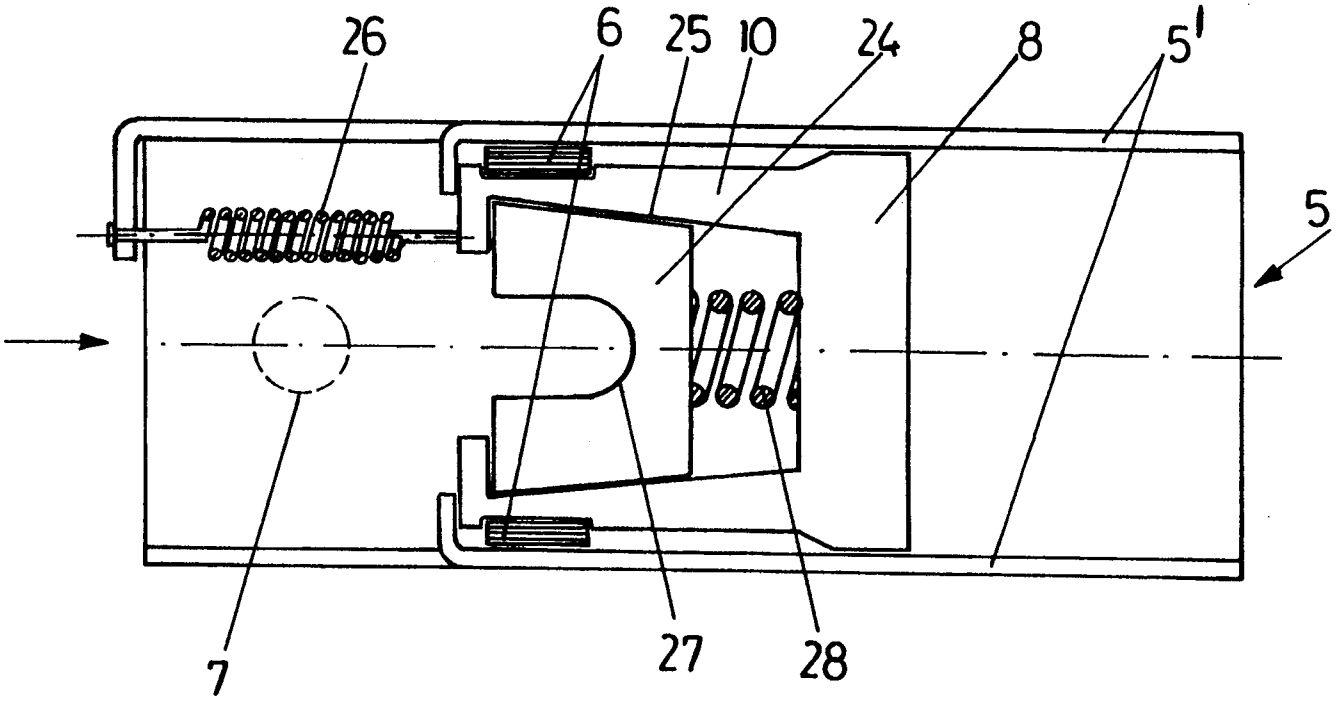
FIGS. 13A–14 are views similar to FIGS. 7A–8, respectively, but of a still further embodiment of the present invention.
Figure 13B:
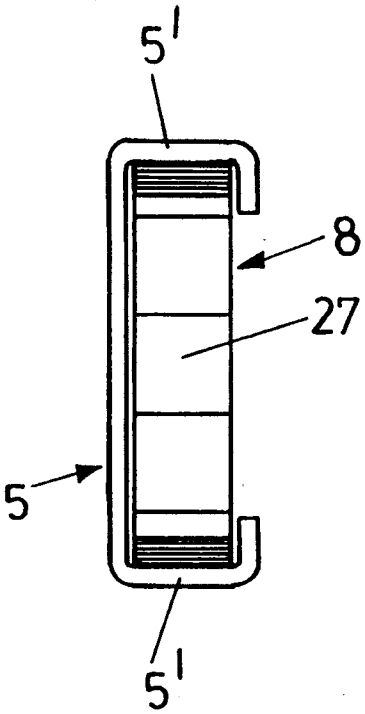
Figure 14:
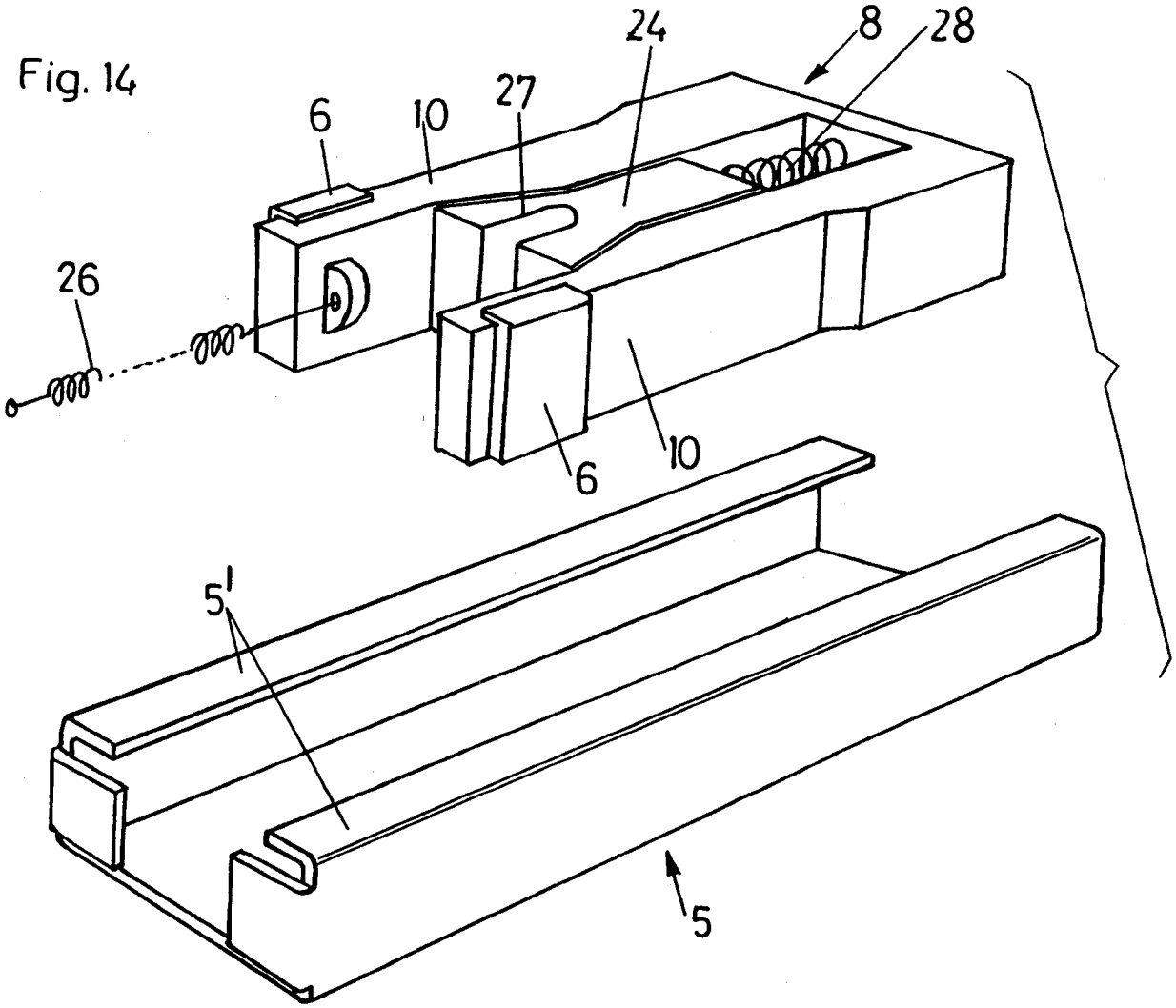

In the embodiment according to FIGS. 13A–14, the brake member includes a U-shaped support 8 and an expansion shoe 24 having inclined wedge surfaces 25 and situated between the arms 10 of the U-shaped support 8. The U-shaped support 8 is connected to the rail 5 by a spring 26. When the drawer is moved in the rear, the stop 7 strikes the expansion shoe 24 and, in particular, moves into a central recess 27 thereof. The expansion show 24 is moved inwardly relative to support 8, against the force of a compression spring 28 therebetween, such that movement is transferred to the U-shaped support 8. Such movement of the U-shaped support 8 is, however, impeded by the spring 26, so that the expansion shoe 24 continues to move inwardly relative to the U-shaped support 8. Thus, the arms 10 are spread apart and the brake shoes 6 push against the flanges 5' of the rail 5.

Figure 15A:
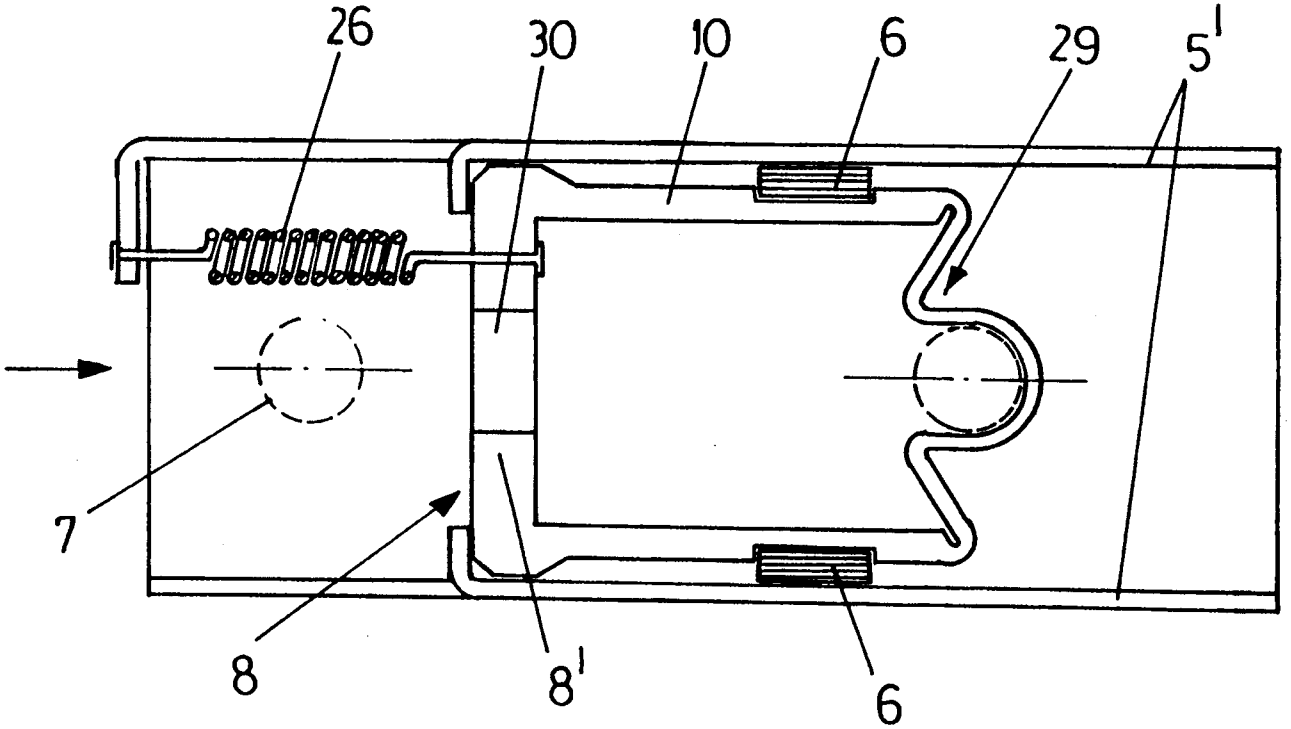
FIGS. 15A–16 are views similar to FIGS. 7A–8, respectively, but of an even further embodiment of the present invention.
Figure 15B:
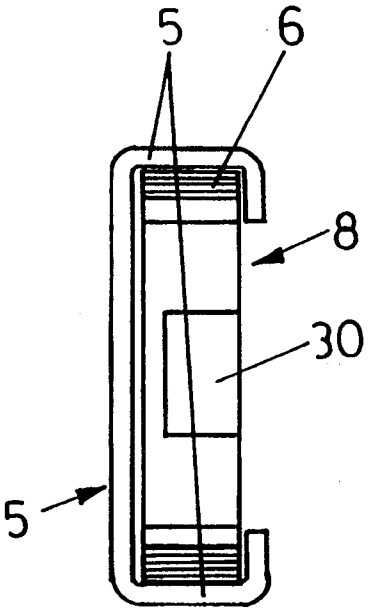
Figure 16:
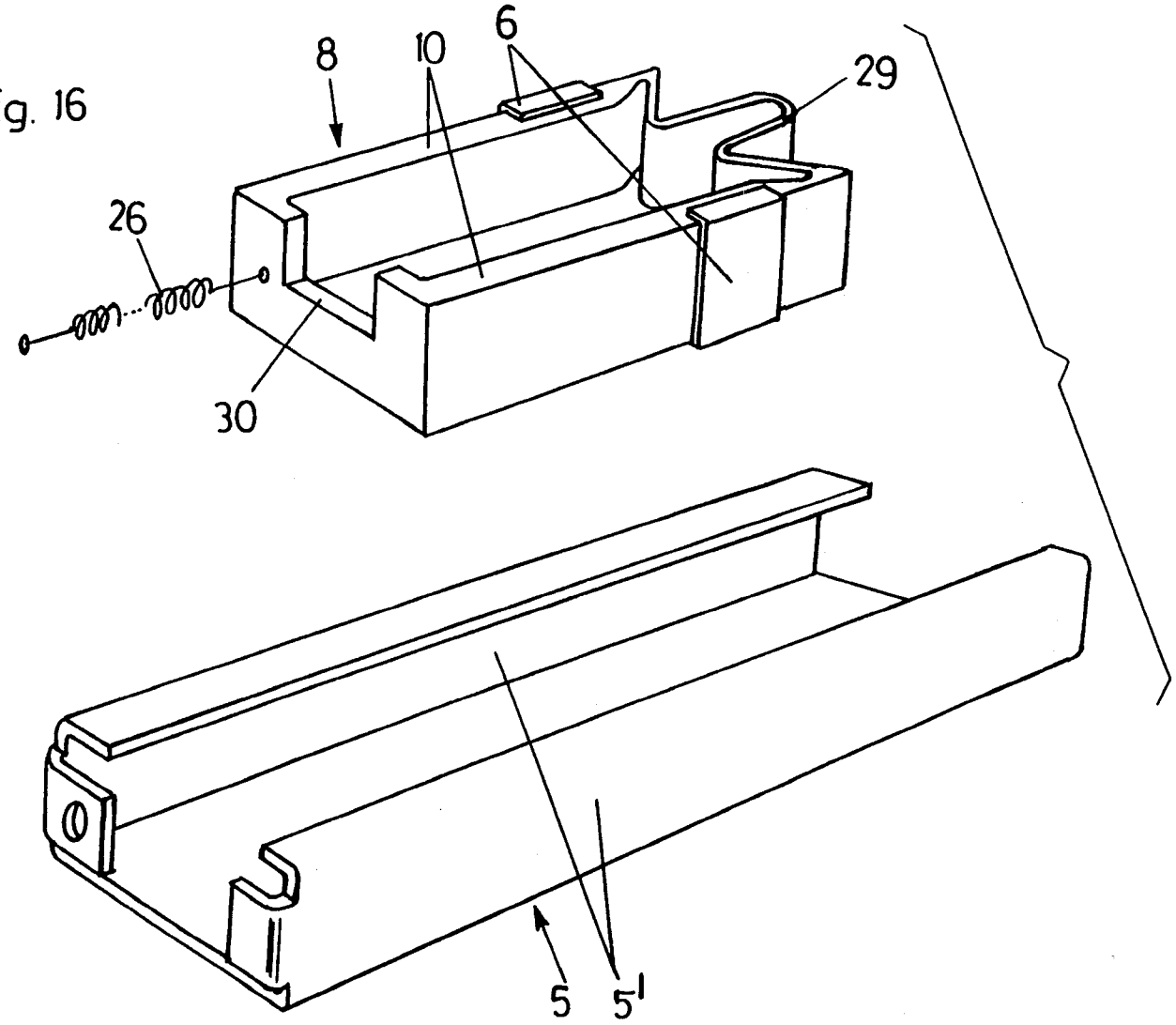

In the embodiment according to FIGS. 15A–16, the brake member is a U-shaped support 8 the arms 10 of which are connected to a toggle joint-like bow 29. In this embodiment, the bow 29 is shaped as one piece with the U-shaped support 8. The U-shaped support 8 in turn is connected to the rail 5 by a spring 26. A center flange 8' of the U-shaped support has therein a recess 30. When the drawer is closed, the stop 7 moves through the recess 30 and strikes the center of bow 29. Since the inner part of the bow 29 is moved rearwardly, the toggle arms of bow 29 undergo toggle joint action and the arms 10 are pushed outwardly. The brake lines 6 thus strike the flanges 5'.

Figure 17A:
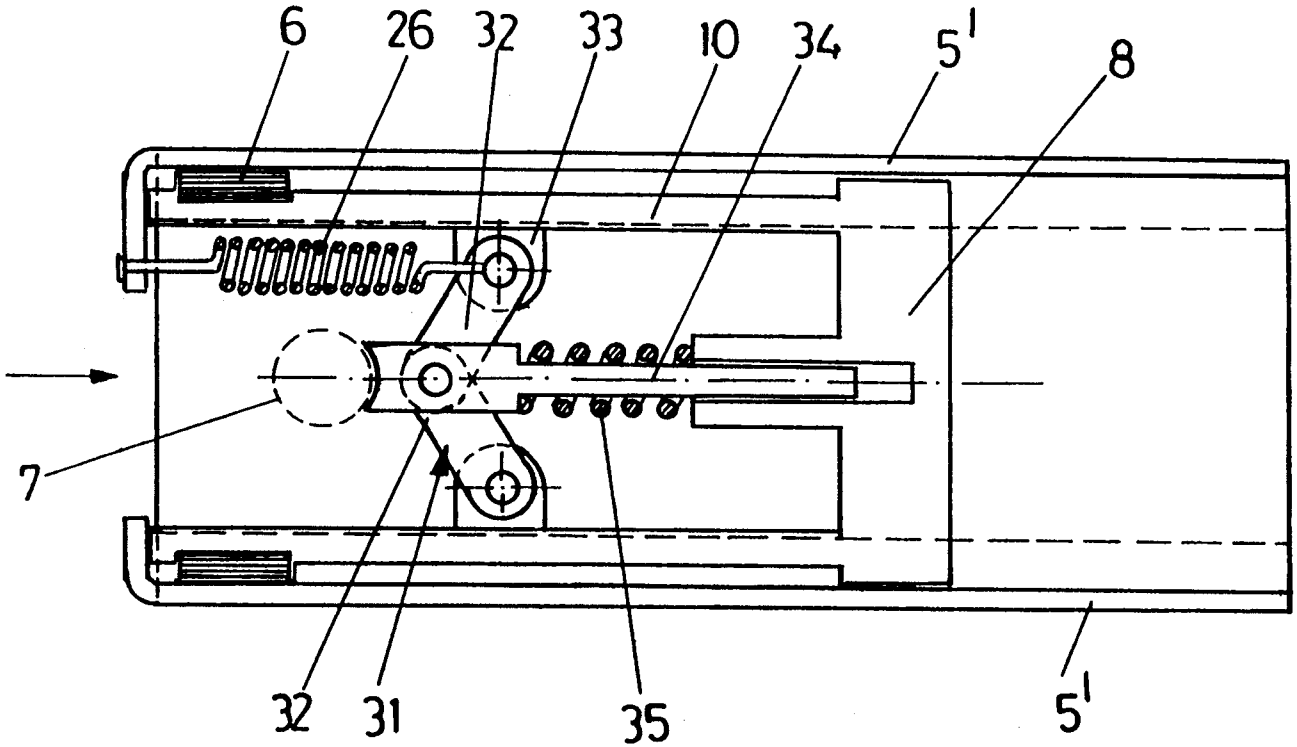
FIGS. 17A–18 are views similar to FIGS. 7A–8, respectively, but of a yet still further embodiment of the present invention.
Figure 17B:
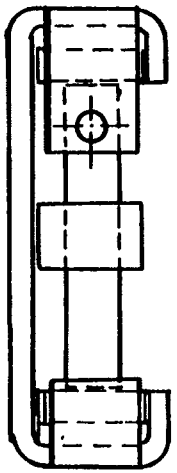
Figure 18:
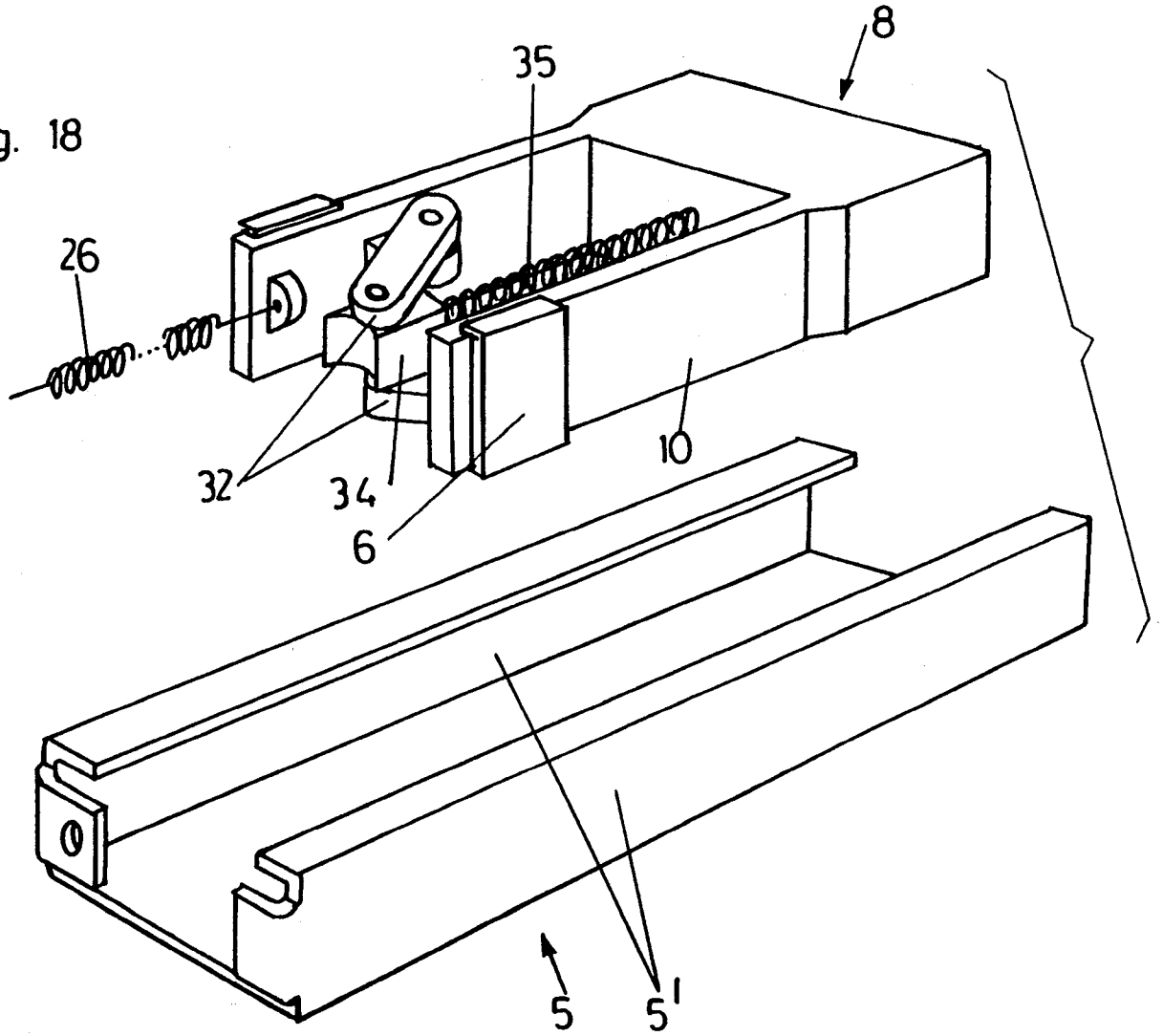

In the embodiment according to FIGS. 17A–18, a true toggle joint 31 is arranged between the arms 10 of the U-shaped support 8. Two articulated levers 32 of the toggle joint 31 are pivoted, on the one hand, on bases 33 mounted on the arms 10 and, on the other hand, on a central ram 34. The ram 34 is stressed forwardly by a compression spring 35 that is braced against the U-shaped support 8. A tension spring 26 connects the U-shaped support 8 to the rail 5. When the drawer is closed, the stop 7 strikes the ram 34 and pushes it to the right counter to the pressure of the spring 35. Due to the spring action of the toggle joint 31, the arms 10 are forced outwardly and the brake shoes 6 push against the flanges 5' of the rail 5.

Figure 19A:
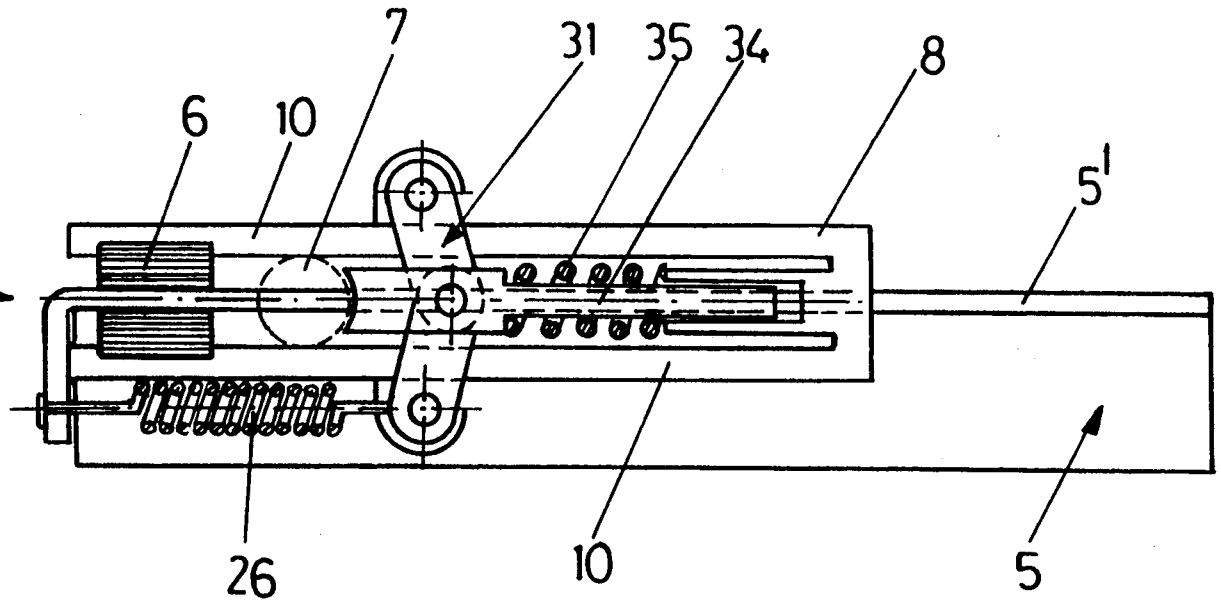
FIGS. 19A–20 are views similar to FIGS. 7A–8, respectively, but of an even further embodiment of the present invention.
Figure 19B:
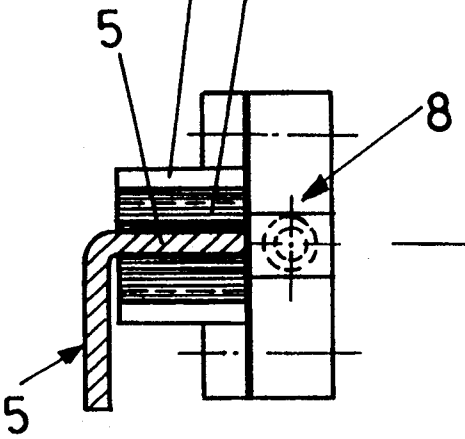
Figure 20:
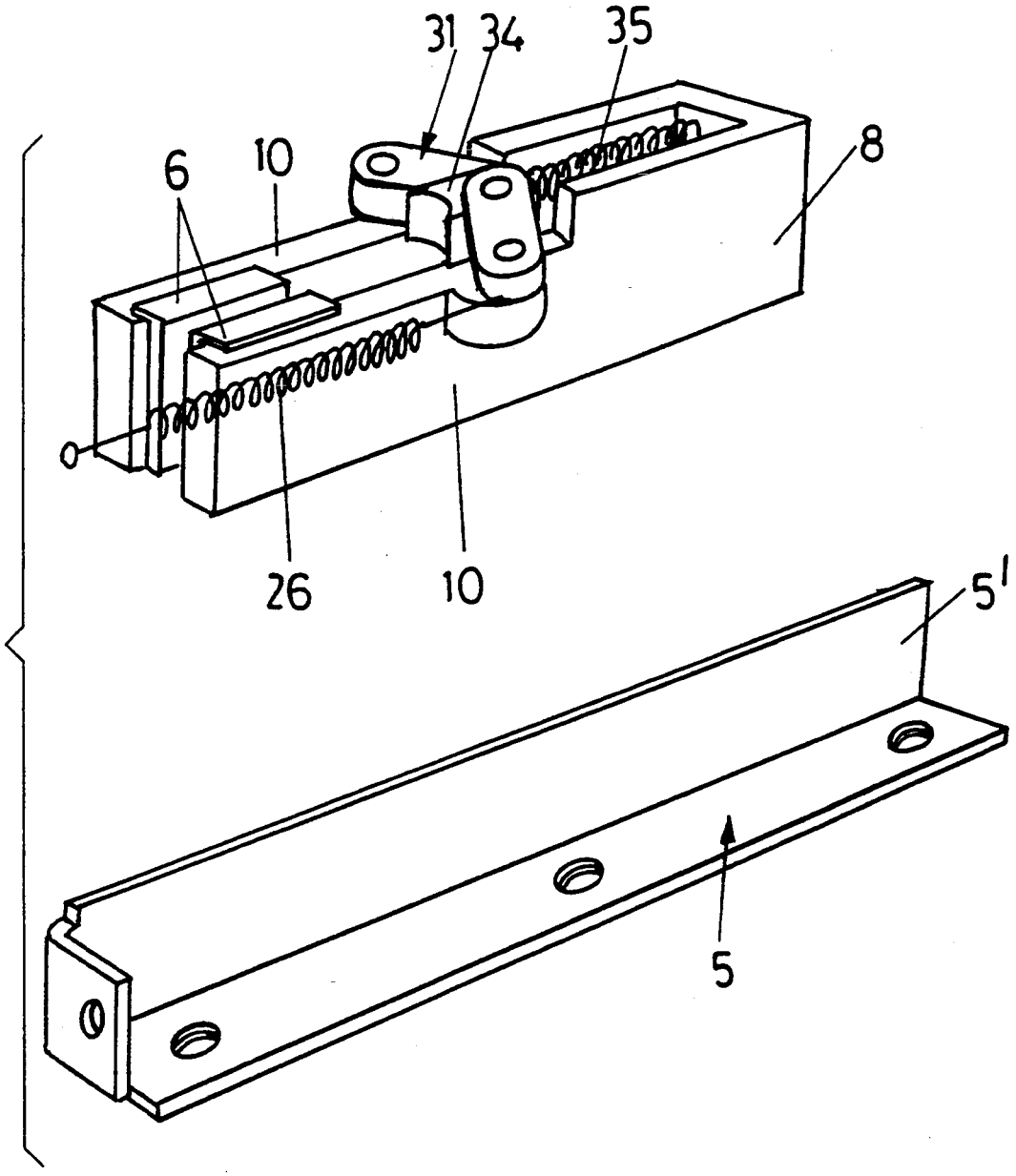

In the embodiment according to FIGS. 19A–20, a toggle joint 31 also is arranged between the two arms 10. The action of the toggle joint in this case is, however, diminished, and braking action is inward. The central joint of the toggle joint 31 is mounted on ram 34, which is stressed by a spring 35 braced at the U-shaped support 8. In contrast to the embodiment according to FIGS. 17A–18 wherein the U-shaped support 8 is guided within a rail 5 having a U-shaped profile, the arms 10 in the embodiment according to FIGS. 18A–20 envelop with their brake shoes 6 a flange 5' of an L-shaped rail 5. When the stop 7 strikes the ram 34 during the slide-in movement of the drawer, the central joint of the toggle joint 31 moves rearwardly and the arms 10 are forced inwardly toward the flange 5' of the rail 5. In so doing, the action of the toggle joint 31 is diminished, i.e. the further the ram 34 is moved relative to the U-shaped support 8, the weaker will be the contact force of the brake shoes 6 at the flange 5'. The U-shaped support 8 is connected to the rail 5 by spring 26.

Figure 21:
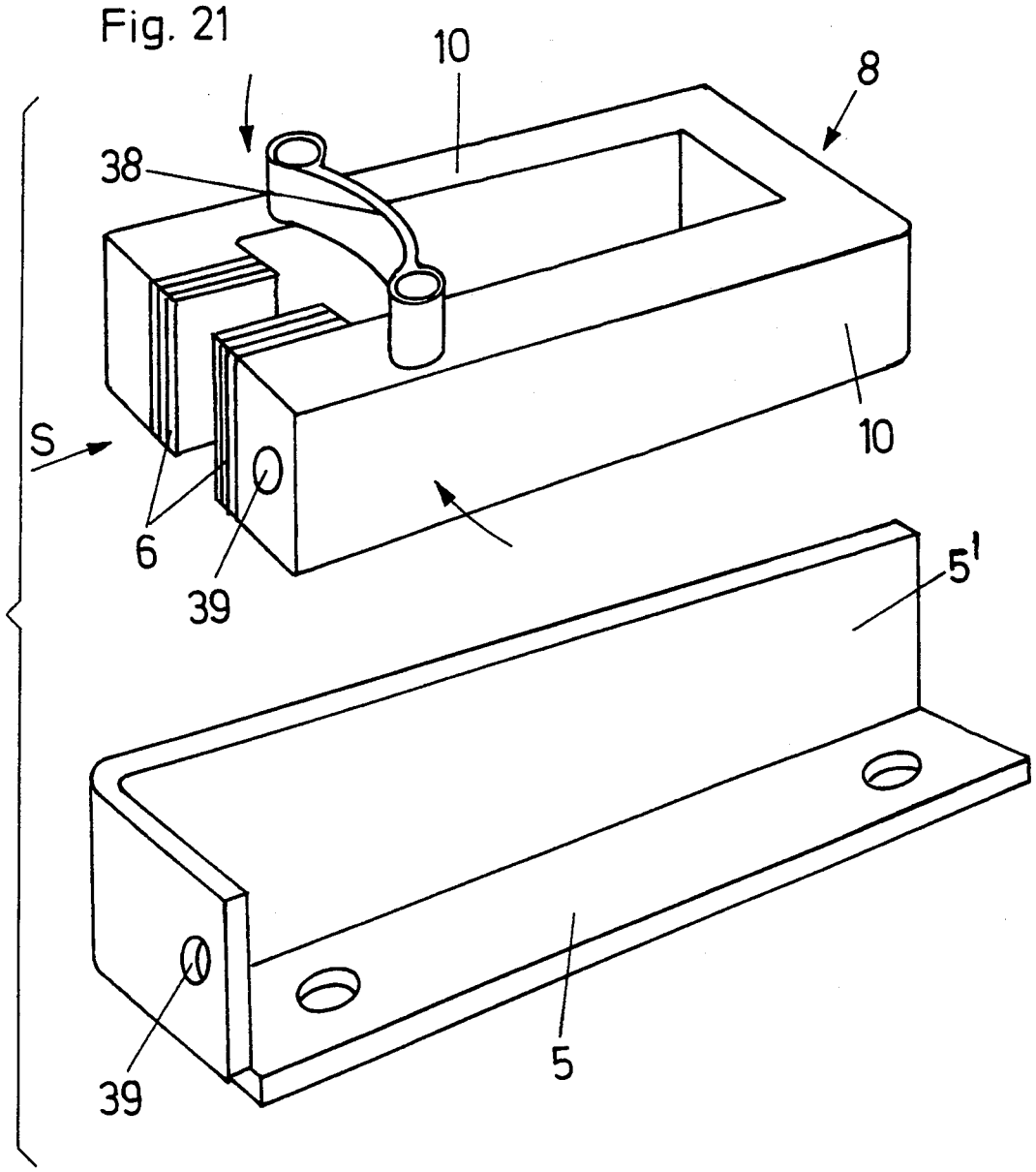
FIG. 21 is a view similar to FIG. 8, but of a still further embodiment of the present invention.

In the embodiment according to FIG. 21, the legs 10 of the U-shaped support 8 are connected together by a bow 38. When the stop 7, moving from the direction of arrow S, strikes the middle of bow 38, the brake shoes 6 are moved inwardly and clamp the flange 5' of the rail 5.

Figure 22:
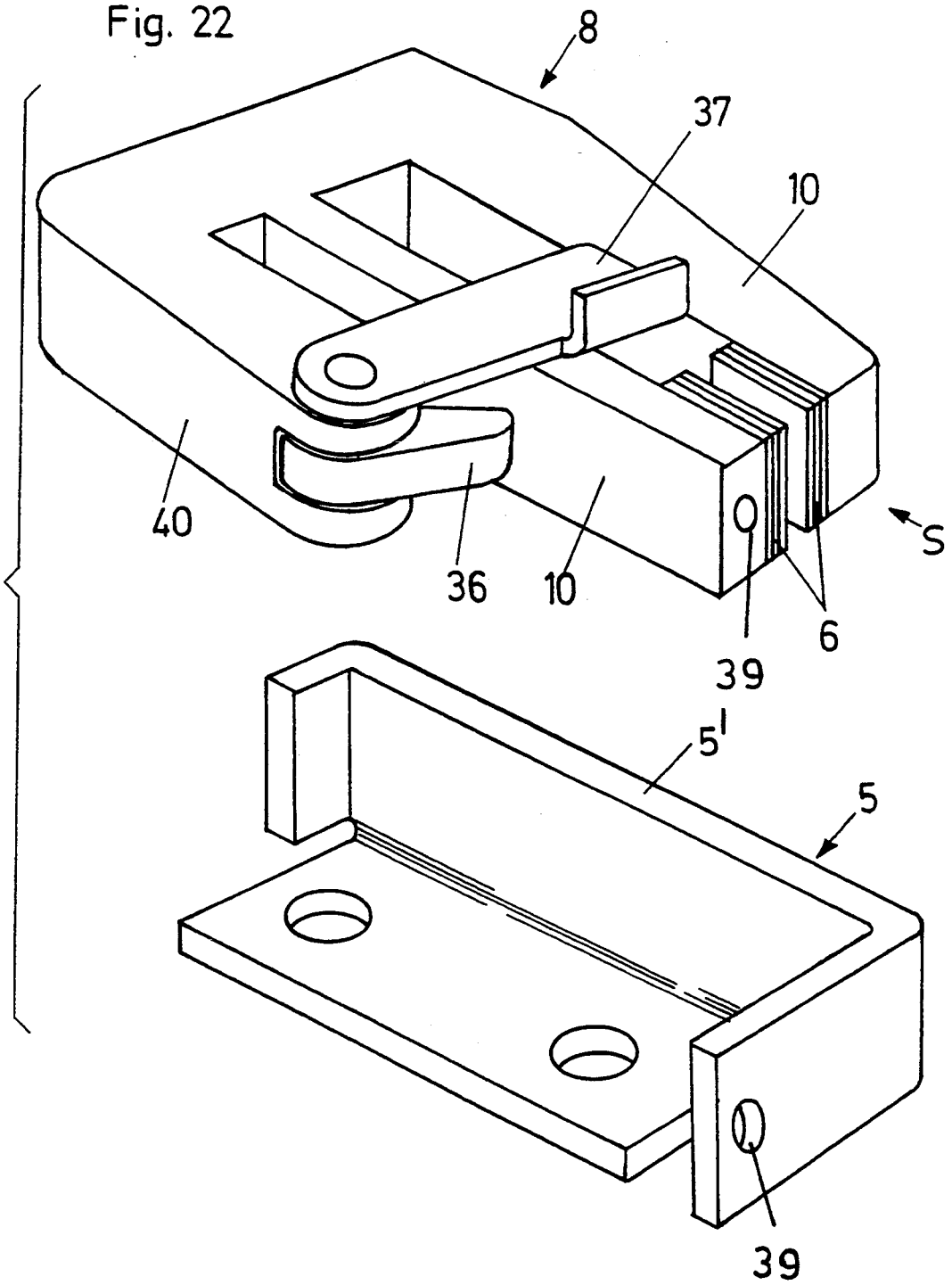
FIG. 22 is a view similar to FIG. 8, but of a still even further embodiment of the present invention.

In the embodiment according to FIG. 22, the U-shaped support 8 is provided with an additional arm 40. A cam 36, which is connected to rotate with a lever 37, is mounted rotatably on arm 40. When the stop 7, moving from the direction of arrow S, strikes the lever 37, lever 37 pivots counter-clockwise as shown in FIG. 22. This causes the cam 36 to similarly pivot and to push the arm 10, against which cam 36 abuts, toward the other arm 10. The flange 5' of the rail 5 thereby is clamped.

In the last two described embodiments, the U-shaped supports are connected to the rails 5 by tension springs suspended from bearing point 39.

We claim:

1. A braking device for use in braking sliding movement of a drawer relative to a furniture body, said device comprising:

a brake rail to be fixed to one of the body or the drawer;

at least one brake shoe mounted on said brake rail to be movable relative thereto and to be brought into braking engagement therewith;

a spring connecting said brake shoe to said brake rail and urging said brake shoe relative to said brake rail in a first direction to be opposite to a direction of drawer movement to be braked; and an element to be fixed to the other of the drawer and the body at a position such that, when the drawer is moved relative to the body in the direction of drawer movement to be braked, said element moves said brake shoe relative to said brake rail in a second direction opposite to said first direction and against the force of said spring and causes said brake shoe to brakingly engage said rail, thus braking the movement of the drawer.

2. A braking device as claimed in claim 1, comprising two said brake shoes.

3. A braking device as claimed in claim 2, further comprising a brake member supporting said brake shoes and movable therewith relative to said rail.

4. A braking device as claimed in claim 3, wherein said brake member comprises a U-shaped support having two spaced arms supporting respective of said brake shoes.

5. A braking device as claimed in claim 4, wherein said brake rail has two spaced flanges between which said support is movable.

6. A braking device as claimed in claim 5, wherein said arms of said support have inwardly inclined surfaces against which abut said element to thereby move said support and said brake shoes in said second direction and to thereby spread apart said arms and move said brake shoes into braking engagement with said flanges.

7. A braking device as claimed in claim 6, wherein said brake rail is part of a pull-out rail or a support rail of a guide assembly for supporting sliding movement of the drawer relative to the body, and said element is a roller of said guide assembly.

8. A braking device as claimed in claim 5, wherein said support includes a stop bracket to be struck by said element to move said support and said shoes in said second direction, and said brake member further comprises a cam rotatably mounted between said arms, and a pendulum extending from said cam and operable, upon said stop bracket being struck by said element, to swing by centrifugal force and to turn said cam between said arms, thus spreading said arms and moving said brake shoes into braking engagement with said flanges.

9. A braking device as claimed in claim 5, wherein said brake member further comprises an expansion shoe positioned between said arms and having inwardly inclined wedge surfaces abutting said arms, said element striking said expansion shoe and moving said expansion shoe in said second direction relative to said support, thus spreading said arms and moving said brake shoes into braking engagement with said rails.

10. A braking device as claimed in claim 5, wherein said brake member further comprises a toggle connecting said arms.

11. A braking device as claimed in claim 10, wherein said toggle is formed integrally with said support and includes a center portion to be moved by said element, thus causing toggle action spreading apart said arms and moving said brake shoes into braking engagement with said flanges.

12. A braking device as claimed in claim 10, wherein said toggle comprises a ram braced against said support and to be abutted by said element to move in said second direction relative to said support, and toggle arms connected to said ram and to respective said arms of said support, such that movement of said ram in said second direction causes said toggle arms to spread apart said arms of said support and move said brake shoes into braking engagement with said rails.

13. A braking device as claimed in claim 4, wherein said brake rail has a single flange with opposite surfaces.

14. A braking device as claimed in claim 13, wherein said brake member further comprises a toggle connecting said arms.

15. A braking device as claimed in claim 14, wherein said toggle comprises a ram braced against said support and to be abutted by said element to move in said second direction relative to said support, and toggle arms connected to said ram and to respective said arms of said support, such that movement of said ram in said second direction causes said toggle arms to move said arms of said support toward each other and to move said brake shoes into braking engagement with said opposite surfaces of said flange.

16. A braking device as claimed in claim 13, wherein said brake member further comprises a bow connecting said arms of said support, such that abutment of said bow by said element bends said bow and moves said arms of said support toward each other and thereby moves said brake shoes into braking engagement with said opposite surfaces of said flange.

17. A braking device as claimed in claim 13, wherein said brake member further comprises a lever mounted on said support for rotation relative thereto upon being abutted by said element, and a cam fixed to said lever and rotatable therewith, said cam abutting one said arm, such that rotation of said lever moves said cam against said one arm, thereby causing relative movement of said arms toward each other and moving said brake shoes into braking engagement with said opposite sides of said flange.

18. A braking device as claimed in claim 3, wherein said brake rail has two spaced flanges, and said brake member comprises two longitudinally aligned wedge members supporting respective said brake shoes and movable between said flanges.

19. A braking device as claimed in claim 18, wherein said wedge members have respective inclined surfaces confronting each other, such that said member abuts a first said wedge member and moves the same in said second direction until said inclined surfaces abut and cause relative sliding movement of said wedge members along said inclined surfaces, thereby moving said brake shoes into braking engagement with said flanges.

20. A braking device as claimed in claim 19, wherein said spring is connected to said first wedge member, and further comprising a compression spring urging a second said wedge member in said first direction.

21. A braking device as claimed in claim 19, further comprising an elastic tongue on one said wedge member and urging said wedge members apart.

22. In an assembly including a furniture body, and a drawer slidable into and out of said body, the improvement comprising a braking device for braking slidable movement of said drawer relative to said body, said braking device comprising:

a brake rail fixed to one of said body or said drawer;

at least one brake shoe mounted on said brake rail to be movable relative thereto and to be brought into braking engagement therewith;

a spring connecting said brake shoe to said brake rail and urging said brake shoe relative to said brake rail in a first direction to be opposite to a direction of drawer movement to be braked; and an element fixed to the other of said drawer and said body at a position such that, when said drawer is moved relative to said body in said direction of drawer movement to be braked, said element moves said brake shoe relative to said brake rail in a second direction opposite to said first direction and against the force of said spring and causes said brake shoe to brakingly engage said rail, thus braking said movement of said drawer.

23. The improvement claimed in claim 19, comprising two said brake shoes.

24. The improvement claimed in claim 23, further comprising a brake member supporting said brake shoes and movable therewith relative to said rail.

25. The improvement claimed in claim 24, wherein said brake member comprises a U-shaped support having two spaced arms supporting respective of said brake shoes.

26. The improvement claimed in claim 25, wherein said brake rail has two spaced flanges between which said support is movable.

27. The improvement claimed in claim 26, wherein said arms of said support have inwardly inclined surfaces against which abut said element to thereby move said support and said brake shoes in said second direction and to thereby spread apart said arms and move said brake shoes into braking engagement with said flanges.

28. The improvement claimed in claim 27, wherein said brake rail is part of a pull-out rail or a support rail of a guide assembly supporting said sliding movement of said drawer relative to said body, and said element is a roller of said guide assembly.

29. The improvement claimed in claim 22, wherein said support includes a stop bracket to be struck by said element to move said support and said shoes in said second direction, and said brake member further comprises a cam rotatably mounted between said arms, and a pendulum extending from said cam and operable, upon said stop bracket being struck by said element, to swing by centrifugal force and to turn said cam between said arms, thus spreading said arms and moving said brake shoes into braking engagement with said flanges.

30. The improvement claimed in claim 27, wherein said brake member further comprises an expansion shoe positioned between said arms and having inwardly inclined wedge surfaces abutting said arms, said element striking said expansion shoe and moving said expansion shoe in said second direction relative to said support, thus spreading said arms and moving said brake shoes into braking engagement with said rails.

31. The improvement claimed in claim 27, wherein said brake member further comprises a toggle connecting said arms.

32. The improvement claimed in claim 31, wherein said toggle is formed integrally with said support and includes a center portion to be moved by said element, thus causing toggle action spreading apart said arms and moving said brake shoes into braking engagement with said flanges.

33. The improvement claimed in claim 31, wherein said toggle comprises a ram braced against said support and to be abutted by said element to move in said second direction relative to said support, and toggle arms connected to said ram and to respective said arms of said support, such that movement of said ram in said second direction causes said toggle arms to spread apart said arms of said support and move said brake shoes into braking engagement with said rails.

34. The improvement claimed in claim 25, wherein said brake rail has a single flange with opposite surfaces.

35. The improvement claimed in claim 34, wherein said brake member further comprises a toggle connecting said arms.

36. The improvement claimed in claim 35, wherein said toggle comprises a ram braced against said support and to be abutted by said element to move in said second direction relative to said support, and toggle arms connected to said ram and to respective said arms of said support, such that movement of said ram in said second direction causes said toggle arms to move said arms of said support toward each other and to move said brake shoes into braking engagement with said opposite surfaces of said flange.

37. The improvement claimed in claim 34, wherein said brake member further comprises a bow connecting said arms of said support, such that abutment of said bow by said element bends said bow and moves said arms of said support toward each other and thereby moves said brake shoes into braking engagement with said opposite surfaces of said flange.

38. The improvement claimed in claim 34, wherein said brake member further comprises a lever mounted on said support for rotation relative thereto upon being abutted by said element, and a cam fixed to said lever and rotatable therewith, said cam abutting one said arm, such that rotation of said lever moves said cam against said one arm, thereby causing relative movement of said arms toward each other and moving said brake shoes into braking engagement with said opposite sides of said flange.

39. The improvement claimed in claim 24, wherein said brake rail has two spaced flanges, and said brake member comprises two longitudinally aligned wedge members supporting respective said brake shoes and movable between said flanges.

40. The improvement claimed in claim 39, wherein said wedge members have respective inclined surfaces confronting each other, such that said member abuts a first said wedge member and moves the same in said second direction until said inclined surfaces abut and cause relative sliding movement of said wedge members along said inclined surfaces, thereby moving said brake shoes into braking engagement with said flanges.

41. The improvement claimed in claim 40, wherein said spring is connected to said first wedge member, and further comprising a compression spring urging a second said wedge member in said first direction.

42. The improvement claimed in claim 38, further comprising an elastic tongue on one said wedge member and urging said wedge members apart.

43. The improvement claimed in claim 22, wherein said brake rail is mounted on said body, and said element is mounted on said drawer.

44. The improvement claimed in claim 22, wherein said braking device is mounted beneath a bottom of said drawer.

45. The improvement claimed in claim 22, wherein said braking device is located adjacent a side wall of said body.

46. The improvement claimed in claim 22, wherein said braking device is positioned to brake said drawer at only a single position thereof relative to said body.

47. The improvement claimed in claim 16, wherein said single position comprises a position of said drawer fully inserted into said body.

* * * * *